US006129469A

United States Patent [19]

Messer et al.

[11] Patent Number: 6,129,469

[45] Date of Patent: Oct. 10, 2000

[54] LOTION APPLICATION DEVICE

[76] Inventors: Mathue Messer; Robert Loftus, both of 1315 Hampton, Schaumburg, Ill. 60193

[21] Appl. No.: 09/320,044

[22] Filed: May 26, 1999

[51] Int. Cl.[7] ..... A46B 5/02

[52] U.S. Cl. ..... 401/6; 401/183; 401/184; 401/185

[58] Field of Search ..... 401/6, 185, 187, 401/188, 183, 184

[56] References Cited

U.S. PATENT DOCUMENTS

| | | | |
|---|---|---|---|
| D. 306,214 | 2/1990 | Delphus | D28/7 |
| D. 343,297 | 1/1994 | Haines | D4/116 |
| D. 351,483 | 10/1994 | Angeletta | D28/7 |
| D. 352,130 | 11/1994 | Zierhut | D28/7 |
| D. 366,727 | 1/1996 | Possmann | D28/7 |
| D. 375,382 | 11/1996 | Beeler | D28/7 |
| 1,189,505 | 7/1916 | Stockton | 401/185 X |
| 2,800,673 | 7/1957 | Lazisky | 401/188 |
| 3,304,573 | 2/1967 | Stefely | 401/187 |
| 3,658,432 | 4/1972 | Lanusse | 401/146 |
| 4,128,350 | 12/1978 | Gamache | 401/208 |
| 4,483,636 | 11/1984 | Meyer | 401/266 |
| 4,896,984 | 1/1990 | Evans | 401/140 |
| 4,961,661 | 10/1990 | Sutton et al. | 401/6 |
| 5,088,849 | 2/1992 | Johnson et al. | 401/6 X |
| 5,568,669 | 10/1996 | Godown | 15/143.1 |
| 5,615,962 | 4/1997 | Staub | 401/173 |

FOREIGN PATENT DOCUMENTS

| | | | |
|---|---|---|---|
| 764159 | 2/1934 | France | 401/185 |
| 1417845 | 10/1965 | France | 401/187 |
| 552305 | 6/1932 | Germany | 401/188 R |
| 2232075 | 12/1990 | United Kingdom | 401/185 |

*Primary Examiner*—David J. Walczak
*Attorney, Agent, or Firm*—John D. Gugliotta

[57] ABSTRACT

Disclosed is a handled device that aids one in applying tanning oil, lotion, soap or sun screen to their back region and other hard-to-reach areas. The long handle portion allows the user to reach the desired area with enhanced ease. It consists of an elongated handle that supports a head with a flat applicator pad constructed of a sponge-like material. The head includes a reservoir that the user fills with the preferred tanning lotion, soap or oil. Connected to a squeeze pump located on the handle opposite the head, the valve allows the user to pressurize the reservoir, causing the lotion, soap or oil to be forced through exit apertures to the applicator pad.

5 Claims, 7 Drawing Sheets

LOTION APPLICATION DEVICE

BACKGROUND OF THE INVENTION

1. Field of the Invention

The present invention relates generally to application devices for applying soaps, tanning oils, lotions and sun screens, and more specifically to a handle application device that allows a user to cover completely his or her back and body region in an easy and convenient manner.

2. Description of the Related Art

Many people enjoy spending their days sun bathing, swimming and performing other outdoor recreational activities under open skies and in the hot summer sun. While these people are often rewarded with a golden tan, they also risk the dangers related to sun burns, sun poisoning and even skin cancer. As a result, most people resort to the use of tanning oils, lotions, sun screens in order to block the harmful UV rays that produce the aforementioned ailments. While these products are effective in providing UV protection, they require that an adequate layer be applied over all of the exposed skin surfaces. While one can usually apply the lotion or oil over the majority of the body, coverage of one's back region is difficult and usually impossible without the aid of another person. As a result, those that perform these activities alone are forced either to go through extreme difficulty in the application of skin protection or, worse yet, must go unprotected. The same difficulties are experienced when people are bathing and showering in the home. Accordingly, the need has developed for a means by which one can apply tanning oils, lotions, sun screens and soaps to his/her back region and other hard-to-reach areas easily and in a manner so as to provide complete and adequate coverage. This device must be capable of use indoors and outdoors, anywhere and anytime, applying the aforementioned lotions, soaps, oils, and sun screens by brushing, sponging, or massaging with any one of several universal textured heads. The development of the present invention fulfills this need.

A search of the prior art did not disclose any patents that read directly on the claims of the instant invention. However, several references to handled lotion application devices were discovered. These devices neither anticipate nor disclose any embodiment that would preclude the novelty and the utilitarian functionality of the features of the present invention.

U.S. Pat. No. 5,568,669, issued in the name of Godown;

U.S. Pat. No. 5,615,962, issued in the name of Staub;

U.S. Pat. No. 4,896,984, issued in the name of Evans;

U.S. Pat. No. 4,483,636, issued in the name of Meyer;

U.S. Pat. No. 4,128,350, issued in the name of Gamache;

U.S. Pat. No. Des. 375,382, issued in the name of Beeler et al.;

U.S. Pat. No. Des. 366,727, issued in the name of Possmann;

U.S. Pat. No. Des. 352,130, issued in the name of Zierhut;

U.S. Pat. No. Des. 351,483, issued in the name of Angeletta;

U.S. Pat. No. Des. 343,297, issued in the name of Haines; and

U.S. Pat. No. Des. 306,214, issued in the name of Delphus.

While several features exhibited within these references may be incorporated into this invention, alone and in combination with other elements, the present invention is sufficiently different so as to make it distinguishable over the prior art.

SUMMARY OF THE INVENTION

The present invention is a handled device that aids one in applying tanning oil, lotion, soap or sun screen to the back region and other hard-to-reach areas. The long handle portion allows the user to reach the desired area with enhanced ease. It consists of a four piece plastic or otherwise handle assembly that supports a neck assembly and head with a contour applicator pad constructed of a sponge-like material. The head includes a reservoir that the user fills with the preferred tanning lotion, soaps or oil. Once the reservoir is filled, it is capped by a threaded cover that includes the male connector portion of a valve assembly. The male connector mates with its female counterpart located in the neck assembly, completing the valve assembly. Locked onto the housing portion by a pair of clips, the neck assembly and applicator head pivots on a ball joint. A squeeze pump located on the handle opposite the head, the pump allows the user to pressurize the reservoir, causing the lotion, soap, or oil to be forced through exit apertures to the surface of the applicator pad. The squeeze pump includes an adjustable air flow valve to allow for lotion, soap or oil flow control. Thus the user can use the present invention to apply a coat of lotion, soap or oil to his/her entire back and body area, unassisted. A cap is provided to cover the head when not in use. The handle portion can be of a four piece design wherein two pivot points allows for extended reach. Furthermore, additional uses such as soap applications in a shower setting are also available. Regardless of the application, use of the present invention ensures both efficient and effective access to those hard-to-reach areas.

It is therefore an object of the present invention to provide a lotion, soap or oil application device wherein sun screen, tanning lotions and tanning oils can be applied to one's back and other hard-to-reach areas easily and effectively, providing complete coverage thereof.

It is another object of the present invention to provide a lotion, soap or application device that eliminates the need for the assistance of a second person to apply lotion or oil to one's back.

It is another object of the present invention to provide a lotion, soap or oil application device that applies an even coat of sun screen, tanning lotions, soaps and tanning oils.

It is another object of the present invention to provide a lotion, soap or oil application device that includes a refillable reservoir that allows the user to select a preferred lotion or oil for use therewith.

It is another object of the present invention to provide a lotion, soap or oil application device that includes a pneumatic delivery system in which a squeeze handle is used to deliver the lotion, soap or oil to the surface of the applicator head.

It is another object of the present invention to provide a lotion, soap or oil application device that includes a rotatably adjustable handle that allows for enhanced reach.

It is another object of the present invention that also includes a four piece detachable handle and allows for a shorter version.

Finally, it is an object of the present invention to provide a lotion, soap or oil application device that includes a pivoting head for maintaining even contact with one's skin surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
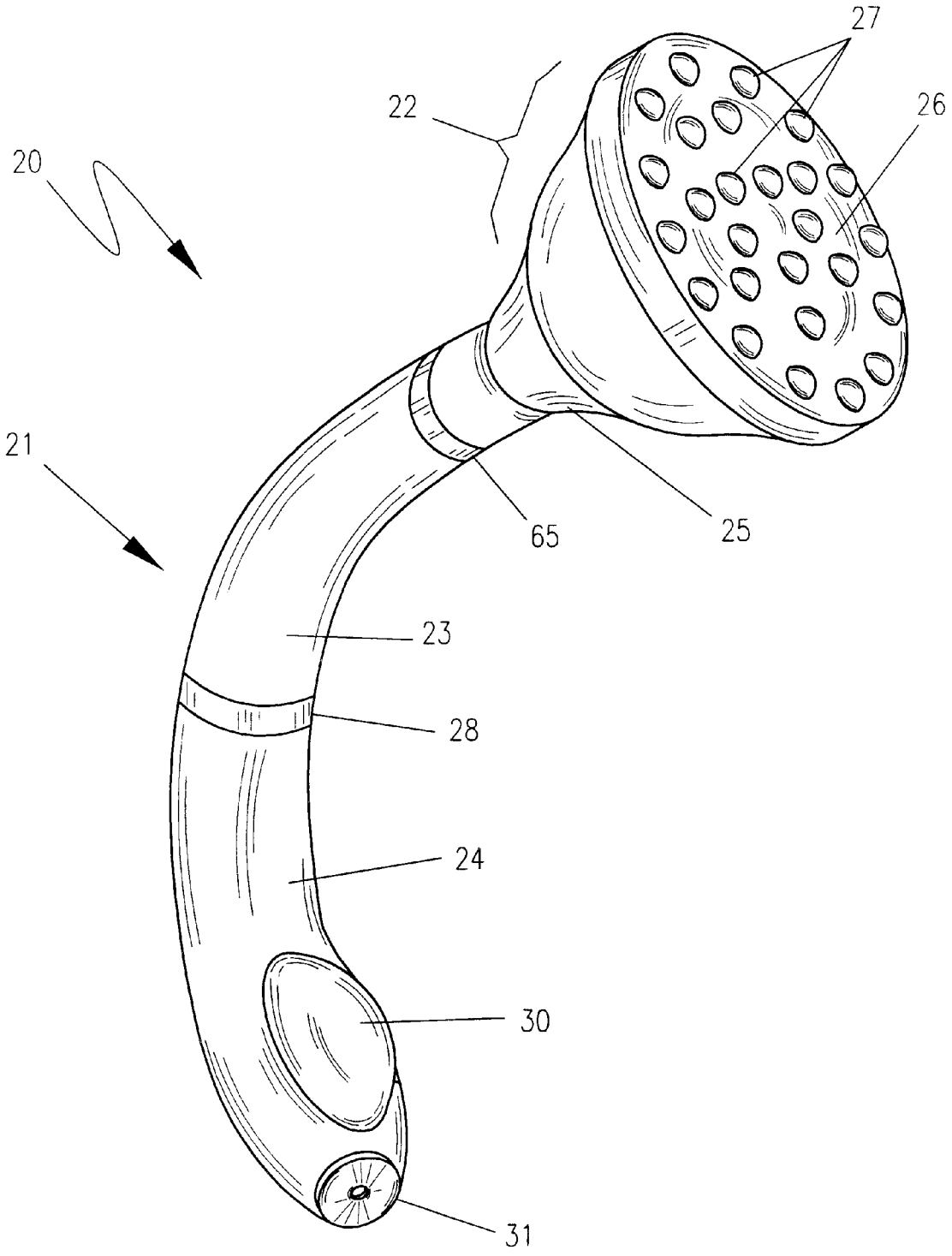
FIG. 1 is a perspective view of the lotion, soap or oil application device, according to the preferred embodiment of the present invention.
Figure 2:
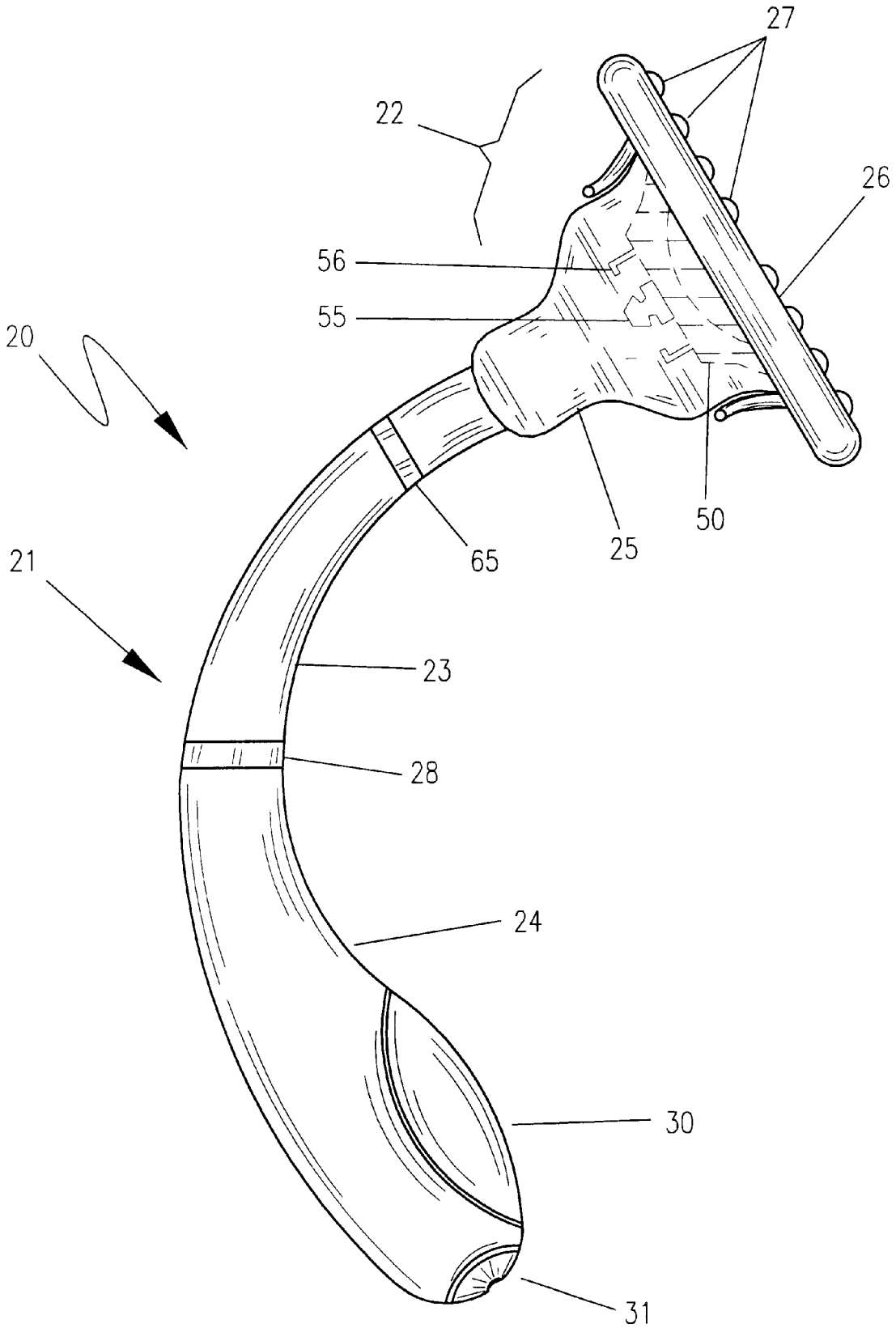
FIG. 2 is a side view of the lotion, soap or oil application device, according to the preferred embodiment of the present invention.
Figure 3:
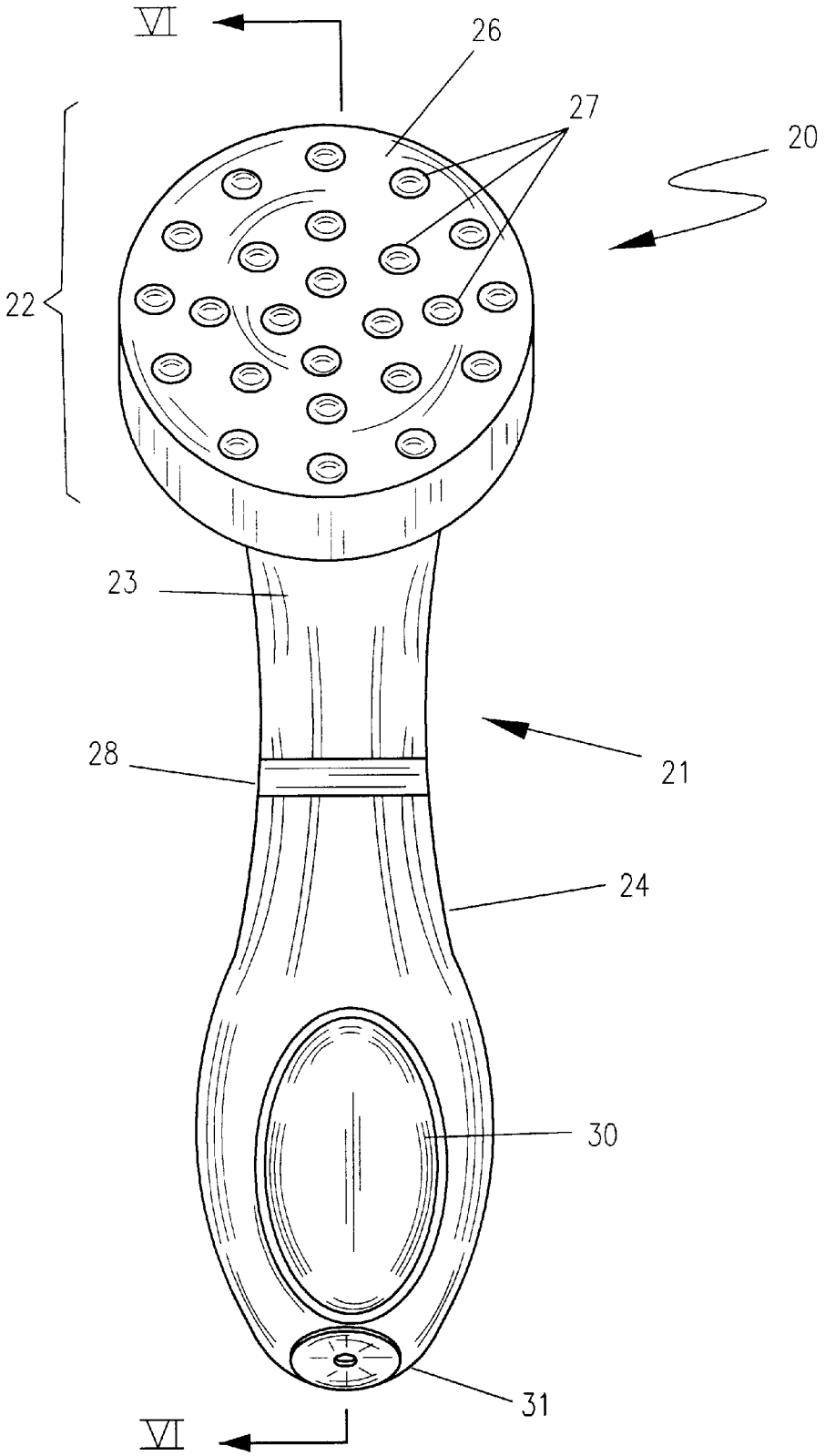
FIG. 3 is a front view of the lotion, soap or oil application device, according to the preferred embodiment of the present invention.

Referring now to FIGS. 1–3, depicted is the lotion, soap or oil application device, hereinafter lotion, soap or oil applicator 20, according to the preferred embodiment of the present invention. The lotion, soap or oil applicator 20 consists, generally, of a four-piece handle 21 that supports a rotating neck assembly 73 and an applicator head assembly 22. The handle 21 is generally elongated and curvilinear in shape, having an upper handle length 23 rotatably connected to a lower handle length 24, the connections being located near the midpoint of the handle 21 and consisting of a handle rotation joint 28 that allows for the rotation of the upper handle length 23 and removal with respect to the lower handle length 24 for enhanced reach. For a shorter version the applicator head assembly 22 consists generally of a contour sponge like applicator pad 26 with nubs 27. Attached to the applicator pad 26 is a lotion, soap or oil dispensing reservoir 50 accompanied with locking guide pins 60 and male connector 55 twistably attached to the rotating neck assembly (not shown). An applicator pad cover (not shown) protects the applicator pad 26 when not in use, preventing the accumulation of dirt and debris and preventing the pad material from drying out.

The applicator pad 26 is formed of a sponge-like cleanable material having a generally porous quality so as to allow it to be moistened with a sun screen lotion, soap or oil, tanning lotion, tanning oil or the like. Once moistened the applicator pad 26 can be used to apply a lotion, soap or oil to one's person in a smooth and even layer. In order to enhance its lotion, soap or oil spreading characteristics, the applicator pad 26 may include nubs 27 protruding from and spaced about the surface thereof. Stored within the applicator head assembly 22, the lotion, soap or oil is dispensed through the dispensing surface 52 by actuating a pneumatic squeeze pump 30 located at the end of the lower handle length 24.

The flow rate of the lotion, soap or oil dispensed by the lotion, soap or oil applicator 20 is controlled by adjusting an air valve 31 located on the lower handle length 24. The air valve 31 allows air to escape therethrough when the squeeze pump 30 is actuated and allows air to enter into the squeeze pump 30 between actuations, as it inflates. Consisting of an adjustable reed valve or other suitable adjustable valve mechanism, the air valve 31 adjusts the amount of air that is allowed to escape when the squeeze pump 30 is actuated. In doing so, the amount of air that is used to dispense the lotion, soap or oil is also adjusted, thereby allowing the user to control the flow rate.

Figure 4:
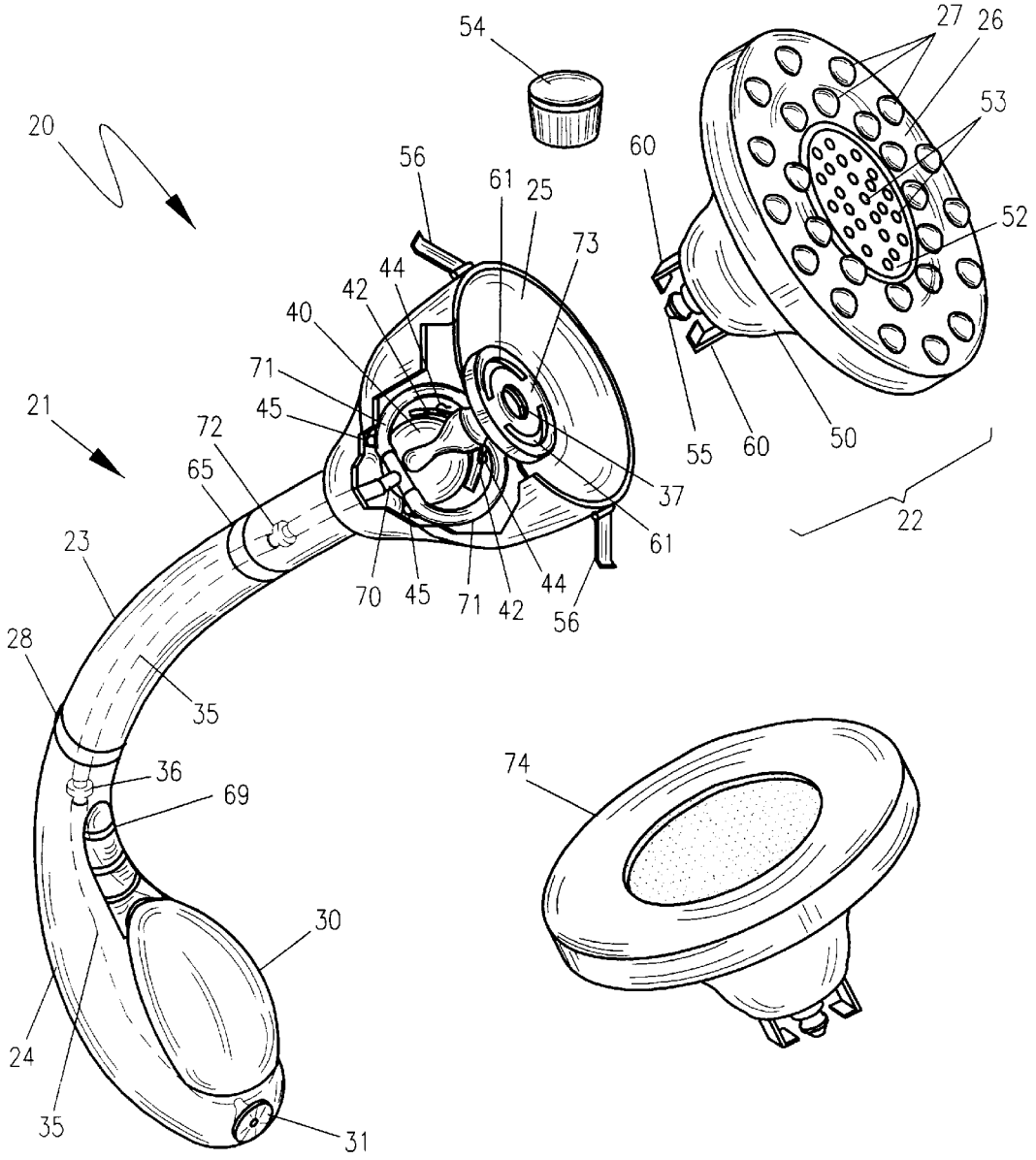
FIG. 4 is a partially exploded perspective view of the lotion, soap or oil application device, according to the preferred embodiment of the present invention.
Figure 5:
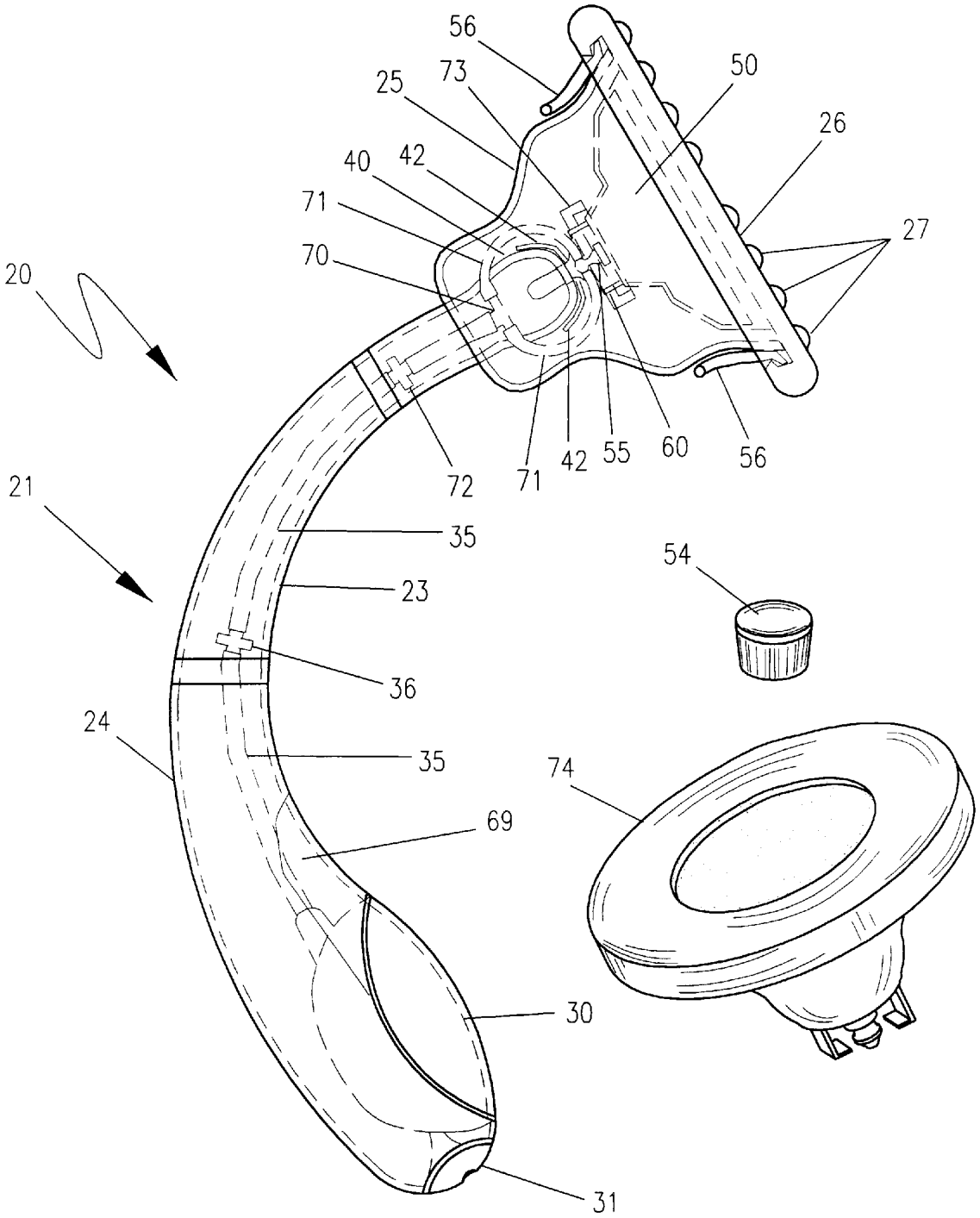
FIG. 5 is a side elevation view of the lotion, soap or oil application device, according to the preferred embodiment of the present invention.
Figure 6:
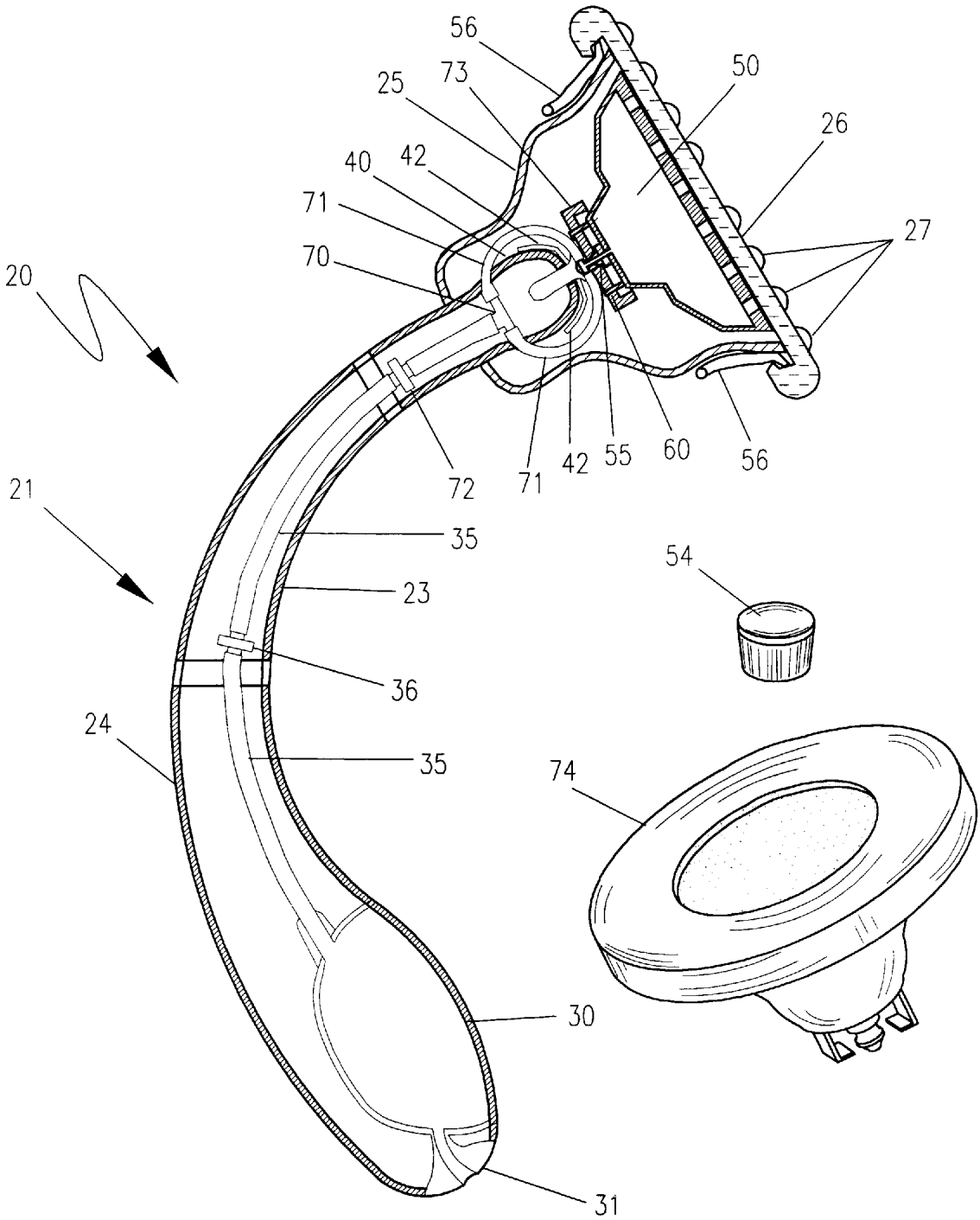
FIG. 6 is a side sectional view of the lotion, soap or oil application device, taken along line VI—VI in FIG. 3, according to the preferred embodiment of the present invention.
Figure 7:
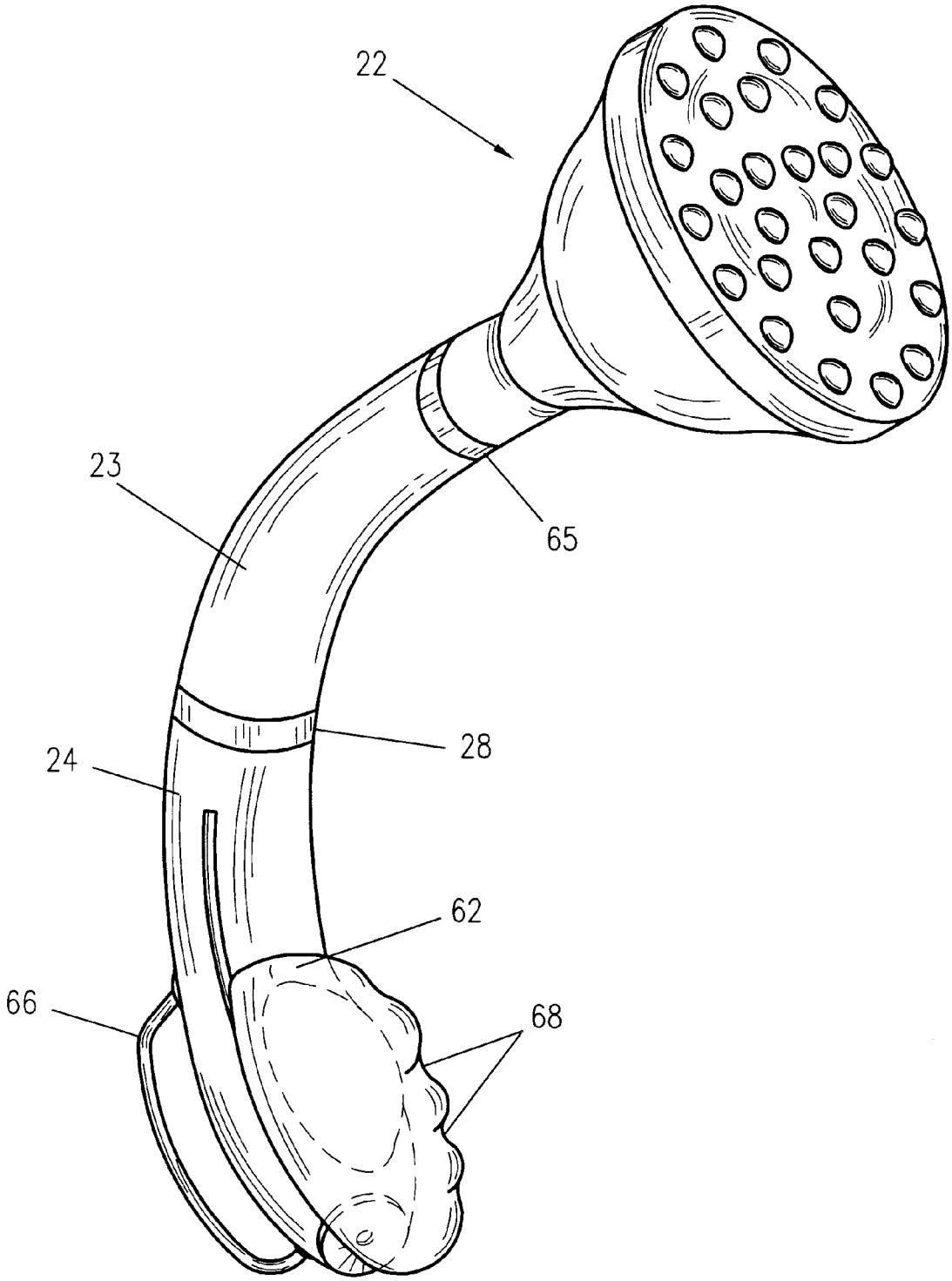
FIG. 7 is a side view of the lotion, soap or oil application device, depicting a variety of features, according to the present invention.
Figure 4:
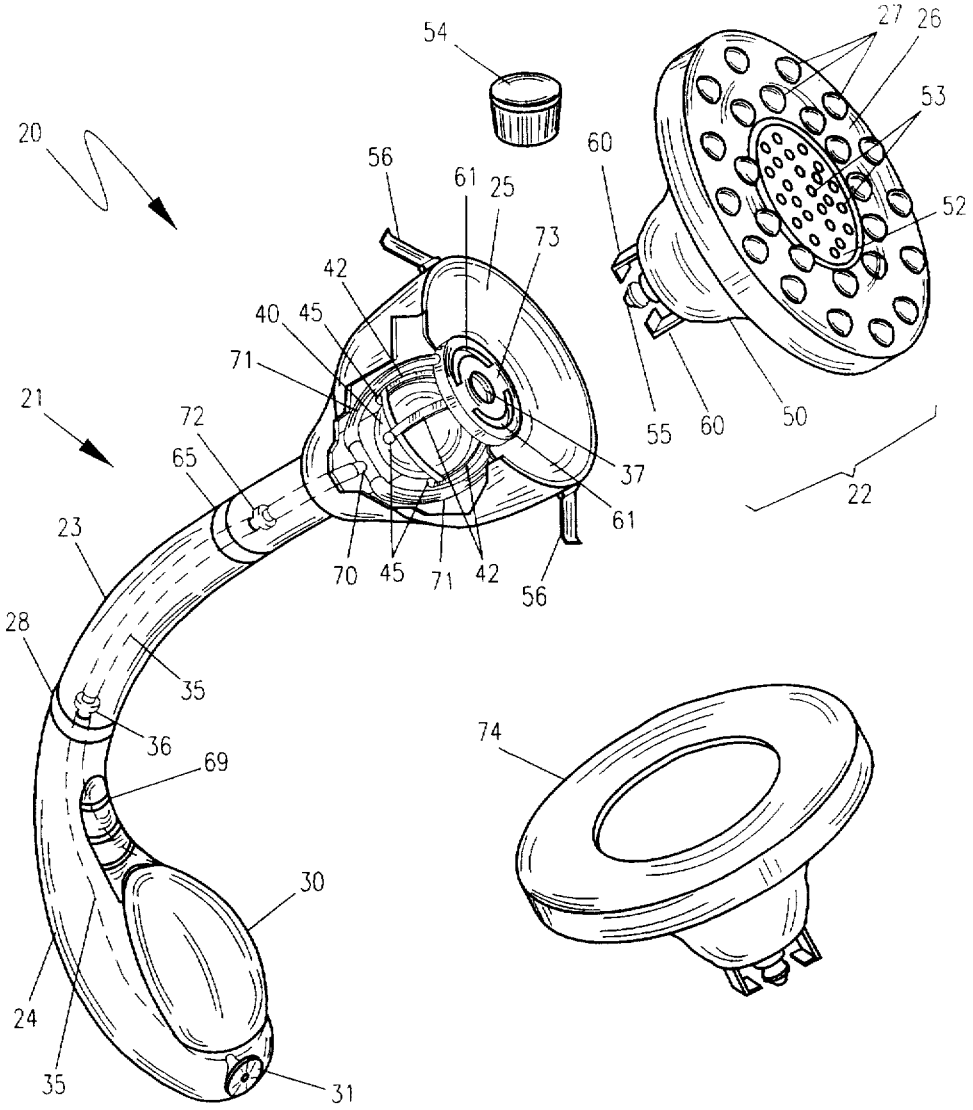
Figure 5:
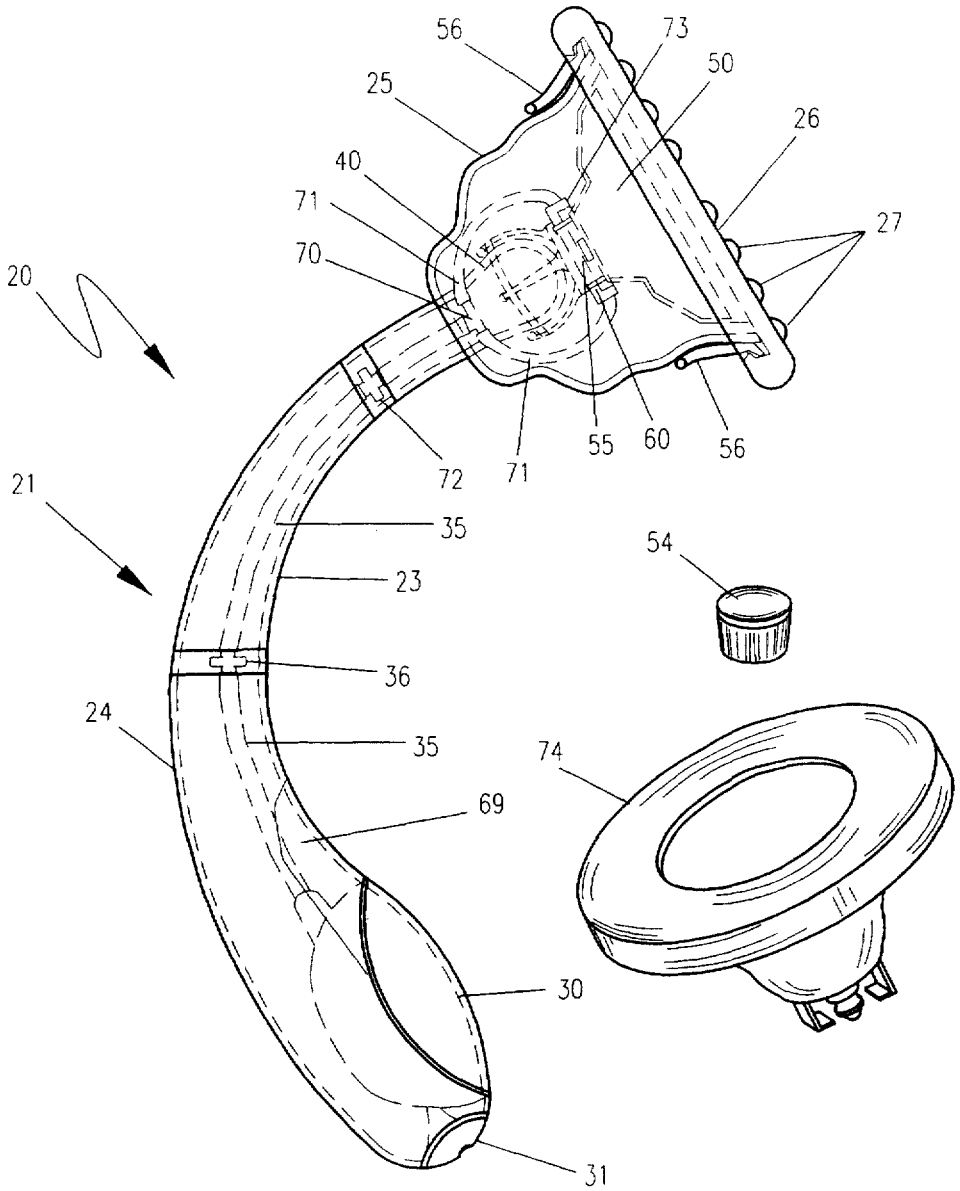
Figure 6:
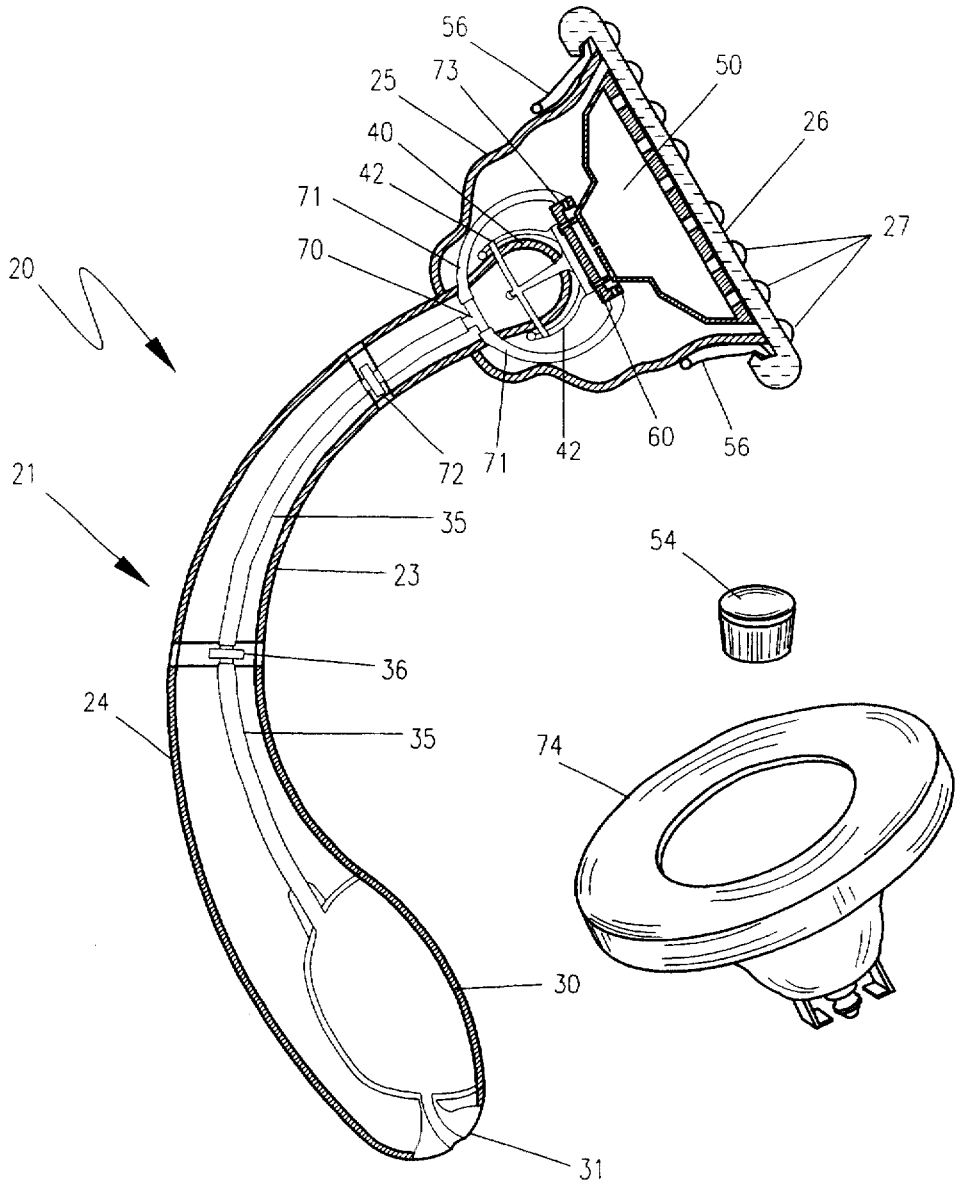

Referring now to FIGS. 4–6, the construction of the lotion, soap or oil applicator 20 is shown in greater detail. The squeeze pump 30 is connected to an air delivery tube 35 that extends the interior length of the handle 21 from the squeeze pump 30 to the applicator head 22. The air tube 35 includes a tube rotation joint 36 and 72, located near the detachable handle rotation joint 28 and 65 near the upper handle length nearest housing base that allows for the rotation of the handle 21. The air tube 35 terminates in the rotating neck assembly 73.

The pivotal attachment of the applicator head 22 to the handle 21 is provided by a rotating neck assembly 73 that connects ball joint 40 to the upper handle length 23. The ball joint 40 is attached to the upper handle length 23 that engages with a plurality of spring biased head securing probes 42 that are attached to the interior portion of the neck housing 25. The head securing probes 42 are pivotally attached to the ball joint 40 and biased by springs 44 so as to apply a clamping force upon the ball joint 40, thus securing the rotating neck assembly 73. Ball bearings 45 incorporated into the head securing probes 42 provide a smooth engagement with the ball joint 40, thus facilitating angular and rotatable adjustability of the applicator head assembly 22. Although a ball joint 40/head securing probe 42 mechanism is provided in the preferred embodiment, it is envisioned that alternate designs such as a conventional ball and socket or universal joint mechanism may prove to be more suitable in terms of functionality and/or cost.

The dispensing reservoir 50 having porous dispensing surface 52 that engages with the applicator pad 26. The dispensing surface 52 has a plurality of dispensing apertures 53 spaced thereabout that allow for the dispensing of lotion, soap, oil, or other liquid substances contained within the dispensing reservoir 50 to the applicator pad 26.

The dispensing reservoir 50 includes a removable cap 54 that allows for filling/emptying the lotion/soap dispensing reservoir 50 with the desired lotion, soap, oil or other substance. The lotion/soap dispensing reservoir 50 includes a male connector cap 55 that mates with the female connector 37, thus allowing air to be delivered to the dispensing reservoir 50 from the squeeze pump 30 via the air tube 35. The male connector 55 is of a one-way valve configuration that allows air to enter the lotion/ soap dispensing reservoir 50 but won't allow air or lotion/soap/oil to escape in opposite directions. The dispensing reservoir 50 is connected to the neck housing 25 by locking clips 56 or other suitable securing device(s). In positioning the dispensing reservoir 50 for attachment to the rotating neck assembly 73, a pair of locking guide pins 60 that protrude from the dispensing reservoir 50 are inserted into locking tracks 61 with a twisting motion. The locking clips 56 used in conjunction with the locking guide pins 60 provide a tight fit between the dispensing reservoir 50 and the rotating neck assembly 73 forming a compression fit between the male connector 55 and the female connector 37 that creates an airtight seal therebetween.

Referring now to FIGS. 1–6, depicted are several features that are incorporated in the lotion, soap or oil applicator 20, according to the present invention. A second handle rotation joint 65 is located on the upper handle length 23 just below the applicator head 22, allowing for enhanced rotational adjustment of the lotion, soap or oil applicator 20. It is the second handle rotation joint 65 that will allow for the removal of the upper handle length 23 for transportation or storage purposes and even for using the lotion, soap or oil applicator 20 in a shortened configuration wherein the ball joint 40 would connect directly to the lower handle length 24.

A variety of features that will serve to enhance the user's grip. A handle strap 66 located on the lower handle length 24 on the side opposite the squeeze pump 30 allows for enhanced grip of the lotion, soap or oil applicator 20. A squeeze pump cover 67 is slidably or snap-on attached to the lower handle length 24. Sliding or snap-on between a pumping position and an application position, the squeeze pump cover 67 allows for a firm grip of the handle 21 while preventing the inadvertent actuation of the squeeze pump 30. The squeeze pump cover 67 features a molded design wherein finger grooves 68 further enhance one's grip while using the lotion, soap or oil applicator 20. Thumb grooves 69 will also enhance one's grip.

Other features not depicted in the figures are also envisioned in alternate embodiments of the present invention. A battery powered version incorporating an electric pump and electric rotating neck and head would automate the lotion, soap or oil or oil delivery system presently powered by the squeeze pump 30 and rotate the head automatically. A universal type joint rather than a rotating joint between the upper handle length 23 and the lower handle length 24 would provide for enhanced reach features.

2. Operation of the Preferred Embodiment

In accordance with the preferred embodiment of the present invention the lotion, soap or oil applicator 20 is used in the following manner. The user first removes the applicator head assembly 22 and fills it with the desired lotion, soap or oil via the cap 54. Once the applicator head assembly 22 is filled, cap 54 is replaced and the lotion, soap or oil reservoir is attached to the neck housing 25 using the locking clips 56 and the locking guide pins 60. Removing the applicator pad cover, the user then begins to actuate the squeeze pump 30, creating a positive pressure within the lotion, soap or oil reservoir 50 and forcing the contents thereof through the dispensing apertures 53 and onto the applicator pad 26. The user can adjust the air valve 31 in order to create the desired volumetric flow of lotion, soap or oil through the applicator pad 26.

Once the applicator pad 26 is moistened to the desired degree, the user then uses the lotion, soap or oil applicator 20 to apply lotion, soap or oil to hard-to-reach areas such as one's back. The user can twist the handle 21, causing rotation of the handle rotation joint 28 and 65, thus altering the shape of the handle 21 and facilitating an enhanced reach or remove for a shorter version. As the user uses the lotion, soap or oil applicator to apply the lotion, soap or oil, the applicator head assembly 22 connected to the neck assembly 73, pivots on the ball joint 40 and maintaining flush contact between the applicator pad 26 and the user's skin surface As the lotion, soap or oil is applied, the nubs 27 spread the lotion, soap or oil smoothly and evenly over the skin. As the lotion, soap or oil in the applicator pad 26 is used, it can be replenished using the squeeze pump 30. Once finished with the lotion, soap or oil applicator 20, the applicator pad cover is replaced, leaving the applicator pad 26 in a ready-to-use state or cleaned easily before storage.

While the embodiments of the invention have been shown, illustrated, and described, it will be apparent to those skilled in this field that various modifications may be made in these embodiments without departing from the spirit of the present invention. Uses such as soap dispensing while bathing and alternative applicator head designs for performing functions such as washing, scrubbing or massaging are not outside the scope of the anticipated use of the present invention. It is for these reasons that the scope of the invention is set forth.

What is claimed is:

1. A lotion applicator for applying tanning lotion, tanning oil, sun screens and other like substances to one's back region and other hard-to-reach areas, said lotion applicator comprising:

a handle having a generally elongated, curved shape, and forming a hollow interior cavity throughout the length thereof, said handle having a pump end opposite a head end;

a squeeze pump housed in said pump end and protruding therefrom allowing for manual actuation, said squeeze pump creating a positive air pressure when actuated;

an applicator head assembly pivotally affixed to said head end, said applicator head assembly further comprising a head housing pivotally affixed to said head end by a head affixing means, said head housing having a dispensing reservoir removable affixed thereto, said dispensing reservoir forming a lotion container having a dispensing surface with a plurality of dispensing apertures in fluid connectivity with said lotion container, said dispensing surface having an applicator pad removably affixed thereto, said dispensing reservoir having a removable cap for filling said dispensing reservoir with a fluid substance, said cap being in fluid connectivity with said hollow interior cavity and having pneumatic receiving means for accepting said positive air pressure; and an air delivery tube having a proximal end opposite a distal end and forming an air conduit throughout the length thereof, said proximal end in fluid connectivity with said squeeze pump and said distal end in fluid connectivity with said pneumatic receiving means, thus delivering said positive air pressure to said dispensing reservoir, pressurizing said lotion container and creating a propelling force by which said fluid substance is dispensed through said dispensing apertures and said applicator pad.

2. The lotion applicator of claim 1 wherein said handle further comprises a two-piece construction wherein an upper handle length is pivotally connected to a lower handle length, allowing for the rotational adjustment of said handle and providing enhanced reach capabilities.

3. The lotion applicator of claim 1 wherein said head affixing means further comprises a ball joint fastener.

4. The lotion applicator of claim 1 wherein said squeeze pump further comprises an adjustable air valve allowing for the adjustability of the volumetric air displacement created by said squeeze pump, thus allowing for the adjustment of said positive air pressure and the dispensing of said liquid substance from said applicator head assembly.

5. The lotion applicator of claim 1 wherein said handle further comprises a three-piece construction wherein a first handle length is pivotally connected to a second handle length, and said second handle length is pivotally connected to a third handle length, allowing for the rotational adjustment of said handle and providing enhanced reach capabilities.

* * * * *

UNITED STATES PATENT AND TRADEMARK OFFICE

CERTIFICATE OF CORRECTION

PATENT NO. : 6,129,469
DATED : October 10, 2000
INVENTOR(S) : Messer et al.

It is certified that error appears in the above-identified patent and that said Letters Patent is hereby corrected as shown below:

Drawings,
Delete drawing sheets 4-6 and substitute therefore the drawings sheets consisting of figs. 4-6 as shown on the attached pages.

Column 4,
Line 14, please delete "applicator head 22" and replace it with -- rotating neck assembly 73 --.
Delete lines 16-20 and replace with -- includes a detachable tube rotation joint 36 and 72, along with the detachable handle rotation joint 28 and 65 near the ball joint 40 and near the center of the handle 21. --
Delete lines 21-22 and replace with -- handle 21 is provided by a rotating neck assembly 73 that connects to ball joint 40 connected to upper handle length 23.. A ball --
Lines 25-26, delete "neck housing 25" and replace with -- rotating neck assembly 73. --
After line 33, after "assembly 22." please insert -- A divergent, tee-connector 70 provides air connection to alternate sides of the rotating neck assembly 73. This is done by a pair of supply tubes 71 in connection with the tee-connector 70. --
Line 50, delete "dispensing reservoir 50" and replace with -- applicator head assembly 22 --.

Column 5,
Line 3, delete "applicator head 22" and replace with -- ball joint 40 --.
Line 38, please delete "cap 54" and replace with -- male connector 55 --.
Delete lines 39-40 and replace with -- reservoir is attached to the rotating neck assembly 73 using the locking guide pins 60 and then the locking clips 56 in order. Removing the --

Column 6,
Line 23, delete "head housing" and replace with -- neck assembly --.
Line 24, delete "head housing" and replace with -- head assembly --.
Line 25, delete "removable affixed thereto"
Line 30, delete "removably affixed thereto"

UNITED STATES PATENT AND TRADEMARK OFFICE

CERTIFICATE OF CORRECTION

PATENT NO. : 6,129,469
DATED : October 10, 2000
INVENTOR(S) : Messer et al.

It is certified that error appears in the above-identified patent and that said Letters Patent is hereby corrected as shown below:

Column 6, (continued),
Delete line 32 and replace with -- reservoir with a fluid substance with a male connector for filling and dispensing said fluid substance, said male connector being in fluid --.

Signed and Sealed this

Second Day of April, 2002

*Attest:*

*Attesting Officer*

JAMES E. ROGAN
*Director of the United States Patent and Trademark Office*